US012185767B2

(12) United States Patent
Sussman et al.

(10) Patent No.: US 12,185,767 B2
(45) Date of Patent: Jan. 7, 2025

(54) INFUSED UNDERGARMENT

(71) Applicant: Trillium Medical Products, LLC, Boynton Beach, FL (US)

(72) Inventors: Jay Sussman, Lake Worth, FL (US); David Choi, Lake Worth, FL (US)

(73) Assignee: Trillium Medical Products, LLC, Lake Worth, FL (US)

( * ) Notice: Subject to any disclaimer, the term of this patent is extended or adjusted under 35 U.S.C. 154(b) by 5 days.

(21) Appl. No.: 17/980,965

(22) Filed: Nov. 4, 2022

(65) Prior Publication Data

US 2023/0141346 A1 May 11, 2023

Related U.S. Application Data

(60) Provisional application No. 63/276,331, filed on Nov. 5, 2021.

(51) Int. Cl.
*A41B 9/00* (2006.01)

(52) U.S. Cl.
CPC ..... *A41B 9/002* (2013.01)

(58) Field of Classification Search
CPC ..... A41B 9/04; A41B 9/002
See application file for complete search history.

(56) References Cited

U.S. PATENT DOCUMENTS 2,102,359 A * 12/1937 Frieman ..... A61F 13/72 604/397
2,418,907 A * 4/1947 Schreiber ..... A61F 13/8405 604/377
2,494,292 A * 1/1950 Frazer ..... A61F 13/72 604/397
2,595,507 A * 5/1952 Beck ..... A61F 13/70 604/397
2,719,976 A * 10/1955 Sussman ..... A41C 1/003 450/103
3,088,462 A * 5/1963 Muto ..... A61F 13/72 604/394
3,312,981 A * 4/1967 McGuire ..... A61F 13/76 2/406
3,490,454 A * 1/1970 Goldfarb ..... A61L 15/46 604/360
3,613,686 A * 10/1971 De Woskin ..... A61F 13/74 604/397
3,749,095 A * 7/1973 Toyama ..... A61F 13/72 604/397
3,875,942 A * 4/1975 Roberts ..... A61F 13/512 604/374

(Continued)

*Primary Examiner* — Richale L Quinn
(74) *Attorney, Agent, or Firm* — McHale & Slavin, P.A.

(57) ABSTRACT

An infused undergarment device for use as a delivery device for colonizing the vagina with *Lactobacillus* in patients who test positive for or report symptoms of vaginitis. The infused undergarment employs a sponge impregnated with *Lactobacillus crispatus* Freeze Dried Powder. The sponge, having channels to direct the powder, is held in place by a mesh fabric sewn into the groin portion of the undergarment, which allows the c n ay delivery of the powder. The undergarment may also be used to help maintain normal flora of the vagina in the absence of symptoms in a prophylactic manner to prevent future infection. The undergarment is sealed in an opaque aluminum foil package to prevent light and environment air from degrading effectiveness.

9 Claims, 7 Drawing Sheets

(56) References Cited

U.S. PATENT DOCUMENTS 3,881,490 A * 5/1975 Whitehead ..... A61F 13/533 604/371
4,244,059 A * 1/1981 Pflaumer ..... A61K 8/19 2/400
4,421,512 A * 12/1983 Papajohn ..... A61F 13/76 604/396
4,731,063 A * 3/1988 Newkirk ..... A41D 27/12 604/347
4,790,836 A * 12/1988 Brecher ..... A61F 13/15211 604/364
4,984,304 A * 1/1991 Brown ..... A41C 1/003 2/400
5,241,710 A * 9/1993 Lockhart ..... A61F 13/74 2/400
5,416,929 A * 5/1995 Braunstein ..... A41B 9/004 450/156
5,490,847 A * 2/1996 Correa ..... A61F 13/476 604/385.04
6,015,816 A * 1/2000 Kostyniak ..... A61K 47/6923 502/411
6,041,446 A * 3/2000 Braunstein ..... D04B 1/243 2/403
6,409,712 B1 * 6/2002 Dutari ..... A61F 13/471 604/347
7,322,966 B1 * 1/2008 Deerin ..... A61F 13/74 604/385.15
7,601,882 B2 * 10/2009 Farbrot ..... A61F 13/8405 424/78.03
7,752,681 B2 * 7/2010 Michel ..... D04B 1/246 2/409
7,858,840 B2 * 12/2010 Hisanaka ..... A61F 13/5116 604/385.28
8,552,249 B2 * 10/2013 Akinsanya ..... A61L 15/44 604/360
8,575,419 B2 * 11/2013 Di Virgilio ..... A61F 13/15699 604/385.101
8,935,813 B2 * 1/2015 O'Leary ..... A41B 9/001 2/400
8,993,832 B2 * 3/2015 Kuroda ..... A61F 13/4704 604/380
9,003,571 B1 * 4/2015 Lewis-Williams ..... A41B 9/04 2/400
9,173,782 B2 * 11/2015 Takken ..... A61F 13/512
9,370,451 B2 * 6/2016 Hardy ..... A61F 13/15211
10,420,854 B2 * 9/2019 Raver ..... A61L 15/44
10,765,564 B2 * 9/2020 Lee ..... A61F 13/4704
11,298,278 B2 * 4/2022 Font Caselles ..... A61F 13/531
11,364,156 B2 * 6/2022 Zhao ..... A61F 13/533
11,850,820 B2 * 12/2023 Liu ..... D04H 13/001
2004/0064120 A1 * 4/2004 Berba ..... A61F 13/4704 604/380
2004/0122386 A1 * 6/2004 Mocadlo ..... A61F 13/8405 604/359
2004/0122396 A1 * 6/2004 Maldonado ..... B32B 3/28 604/383
2006/0101558 A1 * 5/2006 Coleman ..... A61F 13/84 2/400
2007/0135009 A1 * 6/2007 Liao ..... D03D 15/49 442/209
2007/0287981 A1 * 12/2007 Roe ..... A61F 13/5146 604/385.28
2008/0096001 A1 * 4/2008 Emden ..... D03D 15/292 428/222
2008/0109945 A1 * 5/2008 Xia ..... A41B 9/023 2/403
2009/0118574 A1 * 5/2009 Stephenson ..... A41B 9/04 600/38
2010/0152687 A1 * 6/2010 Carlozzi ..... A61F 15/003 604/385.01
2010/0249736 A1 * 9/2010 Png ..... A41B 17/00 604/378
2011/0023216 A1 * 2/2011 O'Leary ..... A41B 9/001 2/400
2012/0255103 A1 * 10/2012 Evenstad ..... A41B 9/02 2/405
2013/0108599 A1 * 5/2013 Comeaux ..... A61P 31/00 424/93.45
2013/0158635 A1 * 6/2013 Federico ..... A61F 7/10 607/108
2013/0281945 A1 * 10/2013 Gallo ..... A61F 13/53 604/289
2014/0295134 A1 * 10/2014 Wood ..... B32B 3/266 428/137
2014/0316363 A1 * 10/2014 You ..... A61F 13/472 604/375
2014/0358092 A1 * 12/2014 Koumans ..... A61M 31/007 424/93.4
2014/0378936 A1 * 12/2014 Coates ..... A61F 13/15268 604/396
2015/0038040 A1 * 2/2015 Gabbay ..... D03D 15/33 442/308
2015/0133017 A1 * 5/2015 Liao ..... D02G 3/328 28/169
2015/0328060 A1 * 11/2015 Bagger-Sjöbäck ..... A61F 13/4702 604/369
2015/0328061 A1 * 11/2015 Bagger-Sjöbäck ..... A61F 13/53 604/369
2015/0354101 A1 * 12/2015 Liao ..... D02G 3/324 428/377
2016/0030249 A1 * 2/2016 Caneppele ..... A61F 13/00085 604/368
2016/0338881 A1 * 11/2016 Hyppolite ..... A61F 13/15268
2017/0258650 A1 * 9/2017 Rosati ..... D04H 1/42
2017/0333260 A1 * 11/2017 Garner ..... A61F 13/47218
2018/0132541 A1 * 5/2018 Wittstadt ..... A41C 3/0035
2018/0318148 A1 * 11/2018 Joshi ..... A61F 13/84
2019/0070229 A1 * 3/2019 Choi ..... A61K 9/0034
2019/0082748 A1 * 3/2019 Mazourik ..... A41C 3/0007
2019/0116888 A1 * 4/2019 White ..... A41B 9/04
2019/0352445 A1 * 11/2019 Zhao ..... C08G 18/6677
2019/0380886 A1 * 12/2019 Hammond ..... A61F 13/49006
2020/0000155 A1 * 1/2020 Etienne ..... A61F 13/505
2020/0008986 A1 * 1/2020 Hopkins ..... A61F 13/47254
2020/0063077 A1 * 2/2020 Nolan ..... B65D 77/04
2020/0068958 A1 * 3/2020 Yabarafundi ..... A41B 9/001
2020/0171107 A1 * 6/2020 Parks ..... A61K 9/0034
2021/0016243 A1 * 1/2021 Yonce ..... B01J 20/28028
2021/0030605 A1 * 2/2021 Kajanthan ..... A41D 31/125
2021/0146000 A1 * 5/2021 Dagger ..... A61F 13/00063
2021/0298296 A1 * 9/2021 Fayed ..... A61L 2/18
2021/0338486 A1 * 11/2021 Dagger ..... A61N 7/00
2021/0338749 A1 * 11/2021 Finlayson ..... A61P 31/10
2021/0352970 A1 * 11/2021 Monaco ..... A41B 9/005
2022/0249301 A1 * 8/2022 Wirsig ..... A61F 13/15756
2022/0378624 A1 * 12/2022 Agud ..... A41B 11/02
2022/0408848 A1 * 12/2022 Krupa ..... A61F 13/15268
2022/0408850 A1 * 12/2022 Laurin ..... A41D 13/0058
2023/0050850 A1 * 2/2023 Miller ..... A41B 9/12
2023/0059401 A1 * 2/2023 Mellos ..... A41B 9/04
2023/0081210 A1 * 3/2023 Gaffney ..... A41D 13/0058 2/237
2023/0149481 A1 * 5/2023 Finlayson ..... A61K 39/09 424/142.1
2023/0228011 A1 * 7/2023 Martin ..... D02G 3/32 139/421

* cited by examiner

INFUSED UNDERGARMENT

RELATED APPLICATION

In accordance with 37 C.F.R. § 1.76, a claim, of priority is included in an Application Data Sheet filed concurrently herewith. Accordingly, the present invention claims priority based upon U.S. Provisional Patent Application No. 63/276,331, filed Nov. 5, 2021, entitled "INFUSED UNDERGARMENT", the contents of which are incorporated herein by reference.

FIELD OF THE INVENTION

The present disclosure is directed to the field of infection treatment and, in particular, to an infused undergarment that can be employed to increase colonization of *Lactobacillus* in women with vaginal infections.

BACKGROUND OF THE INVENTION

Vaginitis, infection or inflammation of the vagina or vulva, is a common issue recognized in gynecology offices all over the country. Whether originating from bacterial or yeast overgrowth, patients complain of discharge, itching, burning, or embarrassing odor. In many cases women report recurrent infections with no recourse for effective long term treatment or prevention. Currently, the best clinical advice is for these women to wear a cotton undergarment, send a culture, and a prescription for antibiotic or antifungal is given. However, this course of action is treating symptoms and does not resolve the underlying cause. When patients are presented with symptoms, cultures are sent to a laboratory for both pathologic organisms and normal flora bacteria. Anecdotal evidence shows a strong pattern can be seen in those with recurring yeast or bacterial infections, namely these women lacked colonization with *Lactobacillus*.

At present, there are no formulations of probiotics that are designed to colonize the vagina directly. There are researchers attempting to develop a vaginal tablet; however, the use of a tablet will require FDA approval, a prescription from a physician to obtain it, and the task of the patient inserting themselves correctly.

It is widely accepted that the presence of *Lactobacillus* in the vagina plays a key role in maintaining pH levels, and serves an active role in host defense mechanisms against pathologic infection. By secreting hydrogen peroxide and antibacterial/antifungal molecules, *Lactobacillus* species have been shown to inhibit growth of *Candida* and bacteria known to cause bacterial vaginosis. In addition, vaginosis has been associated with decreased colony counts of *Lactobacillus*, suggesting that lack of colonization may lead to increased susceptibility to infection.

Products containing *Lactobacillus* are available on the market. However, they are sold in the form of oral tablets which are meant to travel the gut before attempting to reach the vaginal target via a contaminated route.

SUMMARY OF THE INVENTION

Disclosed is a delivery device for use in colonizing the vagina with *Lactobacillus* in patients who test positive for or report symptoms of vaginitis. The device consists of an infused undergarment employing a sponge impregnated with *Lactobacillus crispatus* Freeze Dried Powder. The sponge, having channels to direct the powder, is held in place by a mesh fabric sewn into the groin portion of the garment, which allows the one way delivery of the powder. The infused undergarment may also be used to help maintain normal flora of the vagina in the absence of symptoms in a prophylactic manner to prevent future infection. The infused undergarment is sealed in an opaque aluminum foil package to prevent light and environment air from degrading the effectiveness of the infused undergarment.

An objective of the invention is to colonize the vagina with *Lactobacillus crispatus* bacterium using a wearable garment impregnated with *Lactobacillus* powder.

Another objective of the invention is to provide a probiotic undergarment to provide women with symptomatic relief of symptoms such as itching, burning, discharge, and odor.

Still another objective of the invention is to provide a probiotic undergarment that can result in resolution of bacterial and yeast infection without use of supplemental antibiotics or antifungals.

Another objective of the invention is to use the *Lactobacillus* garment for colonizing the vagina, alleviating symptoms of vaginitis, and treating vaginitis with and without traditional antibiotics/antifungal drugs.

An advantage of an infused undergarment of the invention is that the product provides a noninvasive treatment that administers the probiotic directly to the vulva and vagina. The infused undergarment does not require any insertion of tablets or gels. As the product is not inserted into the body, the patient will not need to have a prescription for the treatment. The active component is composed solely of *Lactobacillus*, making allergic reaction less likely.

Another advantage of the infused undergarment of the invention is that there is no latex in the device, avoiding the risk of latex allergy.

Yet still another advantage of an infused undergarment of the invention is that it allows direct contact with an affected area, which is more effective than taking an oral supplement that has to pass through the digestive system.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE PREFERRED EMBODIMENT

Figure 1A:
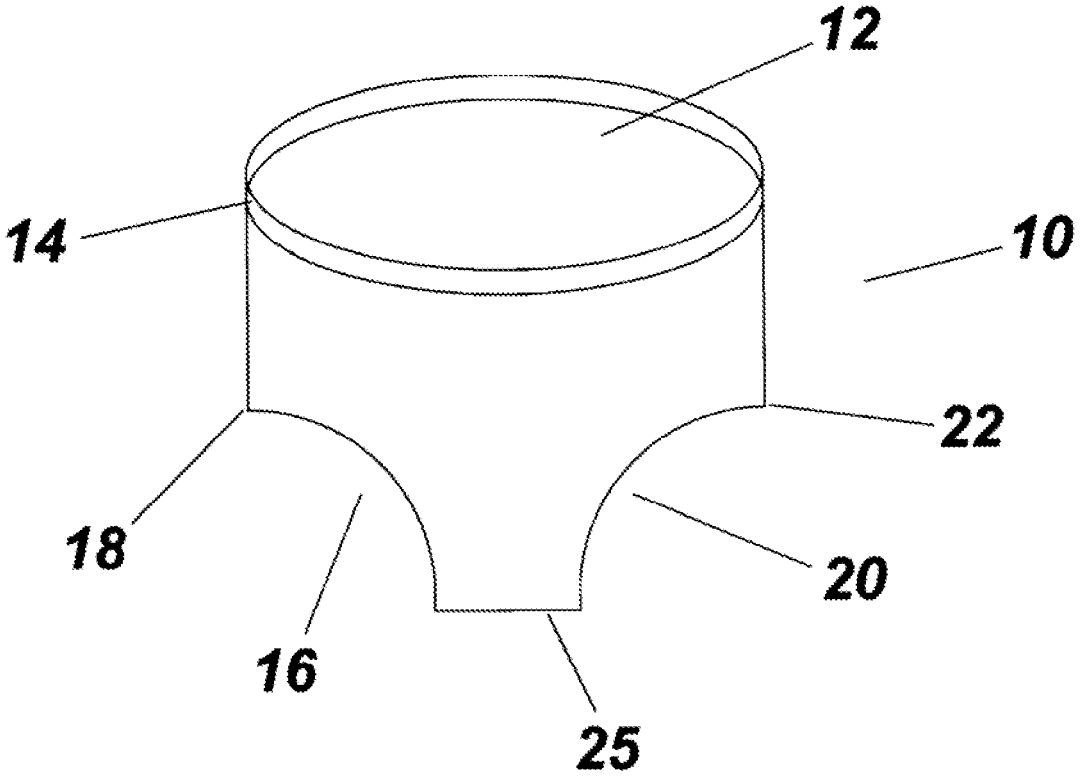
FIG. 1A is a front plane view of the infused undergarment of the instant invention.

While the present invention is susceptible of embodiments in various forms, there is shown in the drawings and will hereinafter be described a presently preferred embodiment with the understanding that the present disclosure is to be considered an exec exemplification of the invention and is not intended to limit the invention to the specific embodiments illustrated.

It is widely known that the presence of *Lactobacillus* in the vagina plays a key role in maintaining pH levels, and serves an active role in protecting against infection. *Lactobacillus* species have been shown to inhibit growth of *Candida* and bacteria known to cause bacterial vaginosis. In addition, vaginosis has been associated with decreased colony counts of *Lactobacillus*, suggesting that lack of colonization may lead to increased susceptibility to infection.

Figure 1B:
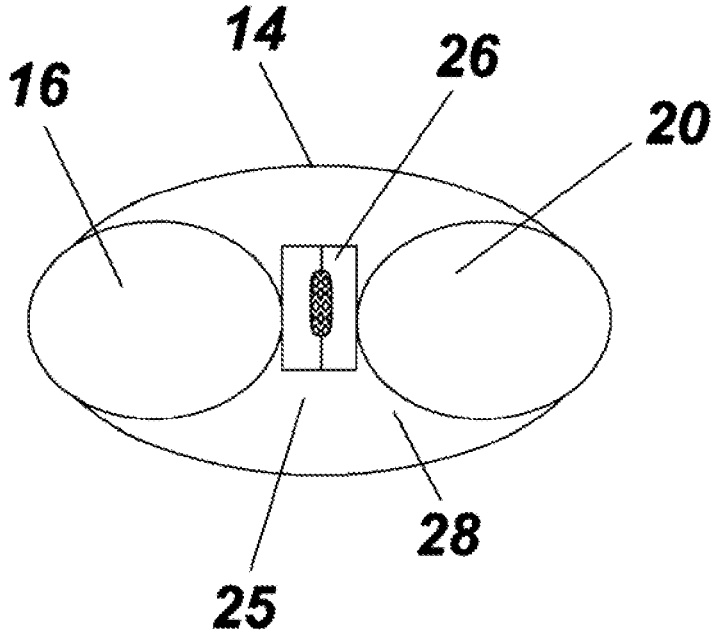
FIG. 1B is a top view thereof.

Referring to FIGS. 1A and 1B, illustrated is an infused undergarment 10 having a preferred use to increase colonization of *Lactobacillus* in women with vaginal infections. The undergarment 10 is formed with a waist opening 12 at the top 14 of the undergarment 10. A left leg opening 16 is formed at the bottom left 18 of the undergarment 10, and a right leg opening 20 is formed at the bottom right 22 of the undergarment 10. A crotch portion 25 is positioned between the left leg opening 18 and the right leg opening 20. The infused undergarment 10 is preferably in the shape of a panty, wherein a receptacle 26 is placed in the crotch portion 25 along the inner surface 28 of the panty. While a panty is depicted, the receptacle can be constructed and adopted to work in an undergarment as small as a thong. The undergarment 10 is constructed of a microfiber material having quick drying and moisture wicking properties. In one embodiment, the undergarment is constructed of a microfiber material having a 50% Polyester and 50% Elasterell blended fabric. In another embodiment, the undergarment is constructed of a microfiber material comprising 25% to 50% Elastane. In one embodiment, the receptacle 26 is formed integral with the undergarment 10. In another embodiment, the receptacle 26 is attached to the inner surface 28 of the crotch area.

Figure 2A:
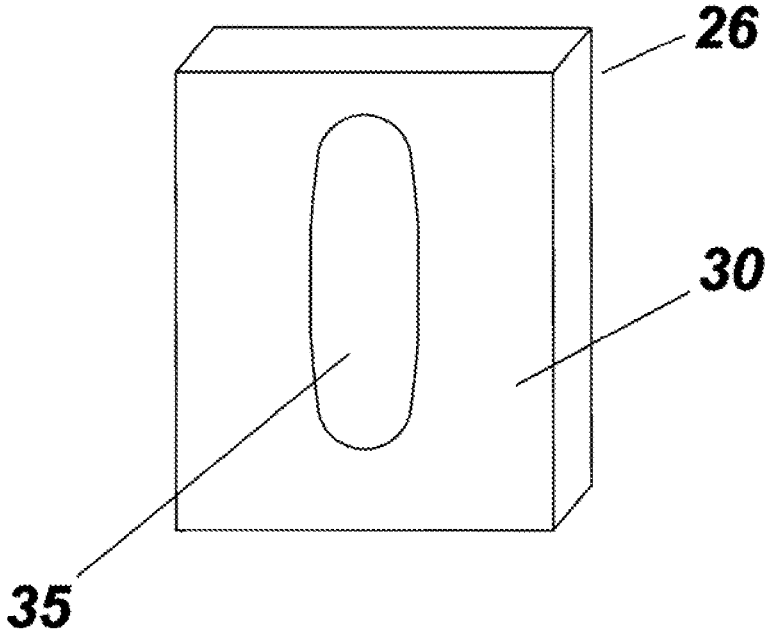
FIG. 2A is a top view of the receptacle.
Figure 2B:
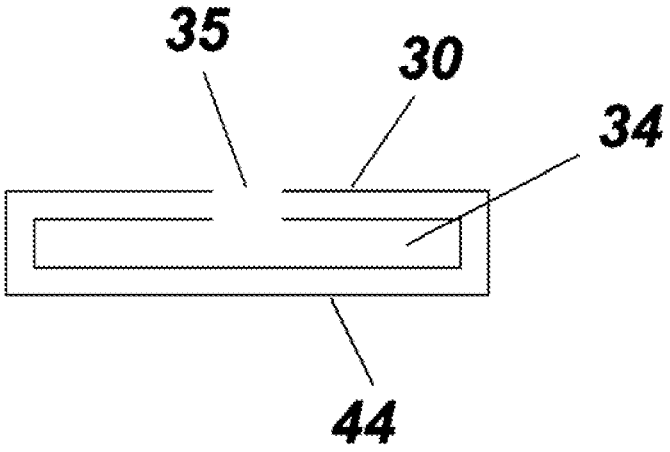
FIG. 2B is a side view thereof.

Referring to FIGS. 2A and 2B, depicted is the receptacle 26 having a substantially rectangular shape with an upper wall 30 and a lower wall 32 to create a cavity therebetween 34; the upper wall 30 including an elongated opening extending a length between the left and right leg openings 16, 20. Should the receptacle 26 not be formed integral to the undergarment 10, the preferred material remains the same as the undergarment, wherein the receptacle 26 is attached by thread.

Figure 3A:
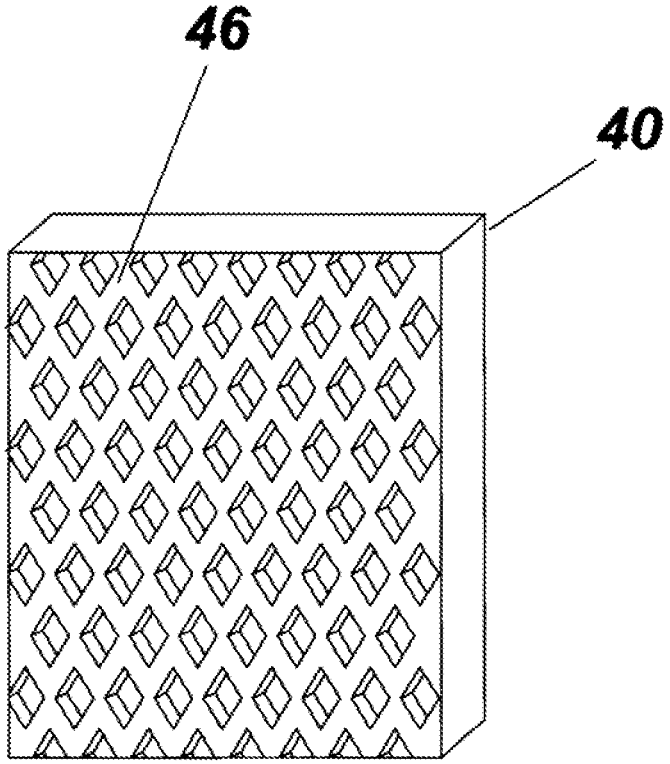
FIG. 3A is a top perspective view of the polyurethane foam member having a diamond shaped upper surface for powder distribution.
Figure 3B:
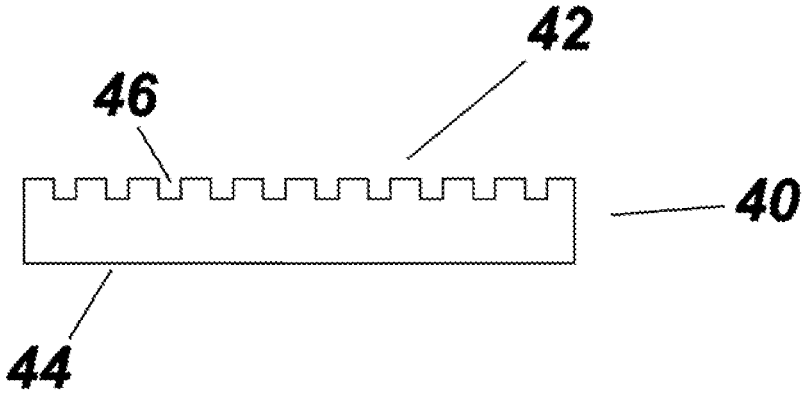
FIG. 3B is a cross sectional side view thereof.
Figure 4:
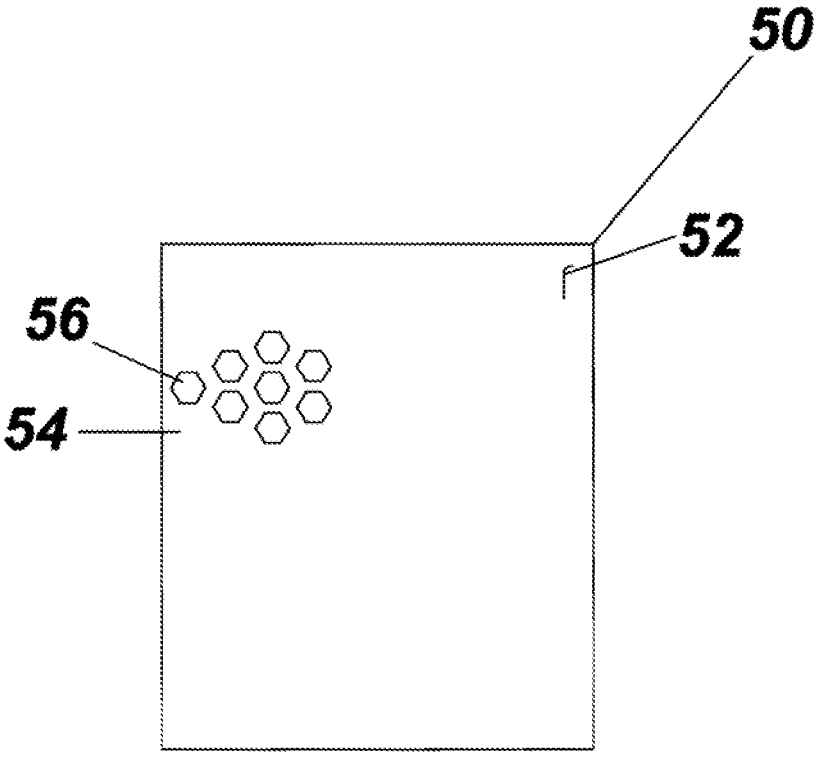
FIG. 4 is a top view of the foam member having a honeycomb shaped upper surface for powder distribution.

Referring to FIGS. 3A and 3B, depicted is a polyurethane foam member 40 to be placed within the receptacle 26. The foam member 40 is an open cell powder-absorbent pad, preferably polyurethane flexible foam made of isocyanates and polyether or polyester polyols. The foam member 40 has an upper surface 42 and a lower surface 44; the upper surface 42 having grooves 46 arranged in a diamond pattern with a depth between 1 mm and 3 mm. One skilled in the art will recognize that the pattern need not be limited to a diamond shape, rather a pattern that has grooves forming a depth is used to hold the powder wherein leg movement operates to help move the powder. For instance in another embodiment a foam member 50 may have an upper surface 52 having grooves 54 with a depth between 1 mm and 3 mm forming a hexagonal or honeycomb pattern 56 as depicted in FIG. 4.

A predetermined amount of *Lactobacillus crispatus* freeze dried powder is infused in the foam member 40. The *Lactobacillus crispatus* freeze dried powder is transferred through the groove 46 for dispersion through an elongated opening 35. The foam member 40 and receptacle 26 cause movement of the powder to be distributed along the grooves 46 and pass through the elongated opening 35 as a result of leg movement by the individual wearing the undergarment 10. The process allows woman to increase the colonization of *Lactobacillus* in addressing vaginal infections comprising the steps of:

Step 1: providing an undergarment 10 defined by a waist opening 12 at the top 14 of the undergarment, a left leg opening 16 at the bottom left 18 of the undergarment, a right leg opening 20 at the bottom right 22 of the undergarment, and a crotch portion 25 in between the left leg opening 16 and the right leg opening 20, and having a receptacle 26 formed integral or attached to said crotch section 25. The receptacle 26 having an elongated opening 35 extending a length between said left leg opening 16 and right leg opening 20.

Step 2: inserting a polyurethane foam member 40 having a predetermined amount of *Lactobacillus crispatus* Freeze Dried Powder infused in the foam member 40 into said receptacle 26.

Step 3: positioning said undergarment 10 on a woman's torso, wherein the individual wearing said undergarment 10 is treated with a release of said *Lactobacillus crispatus* freeze dried powder through said elongated opening 35 during leg movement for treatment of vaginal infections.

Step 4: repeating Steps 1-3 for ten consecutive days.

The foam member 40 with the *Lactobacillus crispatus* freeze dried powder operates in combination with grooves to expel the powder from the receptacle 26 through the opening 35. The leg movement of the individual allows movement of powder within the receptacle 26 and what could be described as a pump. The *Lactobacillus crispatus* freeze dried powder is flowable with good handling and packaging characteristics and formulate to retain functional attributes of the native biomolecule. In the preferred process stated above, the treatment is sold as a kit with ten individual packages of undergarments. The infused undergarment is stored in a sealed aluminum foil package. Sealing of the undergarment allows ease of use by simply opening of the package. The undergarments can be cleaned and reuse wherein the infused foam replacement member would be provided in sealed aluminum packages and inserted into a receptacle of undergarment.

The use of the word "a" or "an" when used conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device that "comprises," "has," "includes" or "contains" one or more steps or elements, possesses those one or more steps or elements, but is not limited possessing only those one more elements. Likewise, a step of a method or an element of a device that "comprises," "has," "includes" or "contains" one or more features, possesses those one or more features, but is not limited to possessing only those one or more features. Furthermore, a device or structure that is configured in a certain way is configured in at least that way, but may also be configured in ways that are not listed.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures, and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An infused undergarment comprising:

an undergarment defined by a waist opening at the top of the undergarment, a left leg opening at the bottom left of the undergarment, a right leg opening at the bottom right of the undergarment, and a crotch portion in between the left leg opening and the right leg opening;

a receptacle formed in said crotch section, said receptacle having an elongated opening extending a length between said left and right leg opening;

a polyurethane open cell foam member positioned within said receptacle, said polyurethane foam member having a grooved surface constructed and arranged to hold powder within the grooved surface, each groove having a depth between 1 mm and 3 mm; and a predetermined amount of medicated Powder infused in said polyurethane foam member grooved surface;

wherein an individual wearing said undergarment is treated with a release of said medicated Powder from said form member as a result of leg movement.

2. The infused undergarment according to claim 1 wherein foam pad is further defined as polyurethane flexible foam made of isocyanates and polyether or polyester polyols.

3. The infused undergarment according to claim 2 wherein said grooves are arranged in a pattern selected from the group consisting of diamond or honeycomb.

4. The infused undergarment according to claim 1 wherein said infused foam member is stored in a sealed aluminum foil package.

5. An infused undergarment to increase colonization of *Lactobacillus* in women with vaginal infections comprising:

an undergarment defined by a front waist opening at the top of the undergarment, a left leg opening at the bottom left of the undergarment, a right leg opening at the bottom right of the undergarment, and a crotch portion in between the left leg opening and the right leg opening;

a receptacle formed in said crotch section, said receptacle having an elongated opening extending a length between said left and right leg openings;

a polyurethane open cell foam member having a grooved surface constructed and arranged to hold *Lactobacillus* Crispatus Freeze Dried Powder, each said groove having a depth between 1 mm and 3 mm positioned within said receptacle; and a predetermined amount of *Lactobacillus* Crispatus Freeze Dried Powder infused in said polyurethane foam member grooved surface;

wherein an individual wearing said undergarment is treated with a release of said *Lactobacillus* Crispatus Freeze Dried Powder from said foam member by said individual wearing the undergarment through leg movement for treatment of vaginal infections.

6. The infused undergarment according to claim 5, wherein said undergarment comprises a microfiber material for quick drying and moisture wicking.

7. The infused undergarment according to claim 6, Wherein said microfiber material is 50% Polyester and 50% Elasterell.

8. The infused undergarment according to claim 6 wherein said microfiber material comprises 25% to 50% Elastane.

9. The infused undergarment according to claim 2 wherein said undergarment is a panty.

* * * * *